US012767424B2

(12) United States Patent
Ludwig

(10) Patent No.: US 12,767,424 B2
(45) Date of Patent: Oct. 20, 2026

(54) POUCH ENCLOSURE HAVING GUSSET-SHAPED FILLING OPENING

(71) Applicant: Illinois Tool Works Inc., Glenview, IL (US)

(72) Inventor: Christopher Ludwig, Buffalo Grove, IL (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 204 days.

(21) Appl. No.: 18/120,467

(22) Filed: Mar. 13, 2023

(65) Prior Publication Data

US 2023/0294909 A1 Sep. 21, 2023

Related U.S. Application Data

(60) Provisional application No. 63/320,316, filed on Mar. 16, 2022.

(51) Int. Cl.
*B65D 83/44* (2006.01)
*B65B 51/10* (2006.01)
(Continued)

(52) U.S. Cl.
CPC ..... *B65D 83/44* (2013.01); *B65B 51/10* (2013.01); *B65D 33/20* (2013.01); *B65D 33/25* (2013.01)

(58) Field of Classification Search
CPC ..... B65D 83/44; B65D 33/20; B65D 33/25; B65D 75/5811; B65D 75/008; B65B 51/10
See application file for complete search history.

(56) References Cited

U.S. PATENT DOCUMENTS 3,173,579 A * 3/1965 Curie ..... B65D 75/5877 222/105
4,430,070 A 2/1984 Ausnit
(Continued)

FOREIGN PATENT DOCUMENTS

EP 1577223 A1 9/2005
EP 2143658 A1 1/2010
WO WO-2016061134 A1 * 4/2016 ..... B65D 33/1683

OTHER PUBLICATIONS

Extended European Search Report mailed Aug. 11, 2023 for corresponding European Patent Application No. 23161826.5 (8 pages).
(Continued)

*Primary Examiner* — Donnell A Long
(74) *Attorney, Agent, or Firm* — Carroll, Hoette & Butscher, LLC; Josef L. Hoffmann

(57) ABSTRACT

An enclosure includes a first panel, a second panel coupled with the first panel along outer edges of the first panel and the second panel, and a gusset panel having first and second legs. The first leg may be coupled with the first panel. The second leg may have opposite ends and a middle portion with at least the middle portion separate from the first panel and the second panel. The second leg and the second panel may form an auxiliary port through which product can be loaded into an interior volume disposed between the first panel and the second panel. The middle portion of the second leg of the gusset panel may be coupled with the second panel after the product is loaded into the interior volume between the first panel and the second panel to enclose the product in the interior volume.

13 Claims, 6 Drawing Sheets

(51) Int. Cl.
*B65D 33/20* (2006.01)
*B65D 33/25* (2006.01)

(56) References Cited

U.S. PATENT DOCUMENTS 5,221,143 A 6/1993 Peppiatt
5,938,337 A 8/1999 Provan et al.
6,071,011 A 6/2000 Thomas et al.
6,138,329 A 10/2000 Johnson
6,148,588 A 11/2000 Thomas et al.
6,164,825 A 12/2000 Larkin
6,279,298 B1 8/2001 Thomas et al.
6,378,177 B1 4/2002 Athans et al.
6,416,221 B2 7/2002 Price
6,662,829 B2 * 12/2003 Credle, Jr. ..... B65D 75/5877 141/10
6,796,712 B1 9/2004 Achhammer
7,186,025 B2 3/2007 Shepard et al.
7,424,796 B2 9/2008 Shepard et al.
7,497,624 B2 3/2009 Totani
8,540,427 B2 9/2013 Steele
9,016,505 B2 * 4/2015 Canegallo ..... B65D 75/5866 220/267
9,469,423 B2 10/2016 Thomas, Jr. et al.
2002/0110291 A1 * 8/2002 Edwards ..... B65D 75/5877 383/104
2011/0229060 A1 9/2011 Koesters
2012/0031923 A1 * 2/2012 Smith ..... B65D 51/002 222/107
2014/0044379 A1 2/2014 Gum
2016/0083161 A1 * 3/2016 Moriz ..... B65D 75/008 383/104
2022/0041338 A1 2/2022 Steele et al.
2023/0002118 A1 * 1/2023 Bazbaz ..... B65D 33/18

OTHER PUBLICATIONS

EPO Exam Report mailed Aug. 6, 2025 for corresponding EP 23 161 826.5 (5 pages).

* cited by examiner

POUCH ENCLOSURE HAVING GUSSET-SHAPED FILLING OPENING

CROSS-REFERENCE TO RELATED APPLICATIONS

This application claims priority to U.S. Provisional Application No. 63/320,316 (filed 16 Mar. 2022), the entire disclosure of which is incorporated herein by reference.

BACKGROUND

Technical Field

The subject matter described herein relates to flexible enclosures, such as flexible packages that hold material within the enclosures.

Discussion of Art

Flexible enclosures can hold a variety of material. One example of a flexible enclosure is a pre-formed pouch enclosure that is filled with the material. Stated differently, the pouch enclosure is first formed, and the material is then added to the pouch enclosure. The pouch enclosure is then sealed with the material inside and then may be presented to customers or consumers.

Some pouch enclosures may be difficult to seal after filling with material. For example, stand-up pouches have larger bottoms on which the pouch stands. But it can be difficult to fill these pouches, as the pouch is usually filled and then a zipper assembly is closed with an additional seal above or outside of the zipper assembly subsequently closed. This can be an additional cost and complexity to providing a full pouch enclosure for customers.

One prior approach to sealing the pouch enclosures includes filling the enclosures via a slit that is later sealed or closed off. One problem with this approach is that other components, such as a valve of the enclosure, can limit where the slit can be formed. This, in turn, can result in the slit being too low to allow for the enclosure to be completely or nearly completely filled with product. As a result, less than 70% of the available volume in the enclosure may not have any product.

BRIEF DESCRIPTION

In one example, an enclosure is provided that includes a first panel, a second panel coupled with the first panel along outer edges of the first panel and the second panel, and a gusset panel having first and second legs. The first leg may be coupled with the first panel. The second leg may have opposite ends and a middle portion with at least the middle portion separate from the first panel and the second panel. The second leg and the second panel may form an auxiliary port through which product can be loaded into an interior volume disposed between the first panel and the second panel. The middle portion of the second leg of the gusset panel may be coupled with the second panel after the product is loaded into the interior volume between the first panel and the second panel to enclose the product in the interior volume.

In another example, a method for forming an enclosure is provided. This method may include coupling a first panel with a second panel along outer edges of the first panel and the second panel, and coupling a first leg of a gusset panel with the first panel while keeping a middle portion of a second leg of the gusset panel separate from the first panel and the second panel. Separation of the middle portion of the second leg of the gusset panel from the second panel may form an auxiliary port through which product can be loaded into an interior volume disposed between the first panel and the second panel. The middle portion of the second leg of the gusset panel may be coupled with the second panel after the product is loaded into the interior volume between the first panel and the second panel to enclose the product in the interior volume.

In another example, a pouch enclosure is provided and may include a front panel having a valve through which a product is dispensed, a back panel coupled with the front panel along an outer edge of the front panel and the back panel, and a gusset panel having lower and upper legs separated from each other by a bend in the gusset panel. The upper leg may be coupled with the front panel. The lower leg may have at least a middle portion that is separate from the front panel and the back panel. The middle portion of the lower leg and the back panel may form an auxiliary port through which the product can be loaded into an interior volume disposed between the front panel and the back panel. The middle portion of the lower leg of the gusset panel may be coupled with the back panel after the product is loaded into the interior volume between the front panel and the back panel to enclose the product in the interior volume.

BRIEF DESCRIPTION OF THE DRAWINGS

The inventive subject matter may be understood from reading the following description of non-limiting embodiments, with reference to the attached drawings, wherein below.

DETAILED DESCRIPTION

One or more embodiments of the inventive subject matter described herein provide a pouch enclosure having an auxiliary port through which product can be inserted or loaded into the enclosure and then sealed shut. The pouch enclosure optionally can be a stand-up type enclosure having a gusseted bottom or bottom gusset that allows the enclosure to vertically stand when filled with product. The product can be a fluid (e.g., liquid, gel, or the like) or other flowable material (e.g., a solid material that can flow, such as granules, powder, or the like). The pouch enclosure optionally can include a valve through which the product can be dispensed from inside the pouch enclosure to outside of the pouch enclosure. After filling the enclosure with the product, the auxiliary port can be sealed. For example, the auxiliary port can be heat sealed (where one side of the port is partially melted to bond with another, opposite side of the port). Alternatively, the auxiliary port can be closed using a press-to-close mechanism or zipper mechanism, which may allow for the enclosure to be re-filled one or more additional times.

Figure 1:
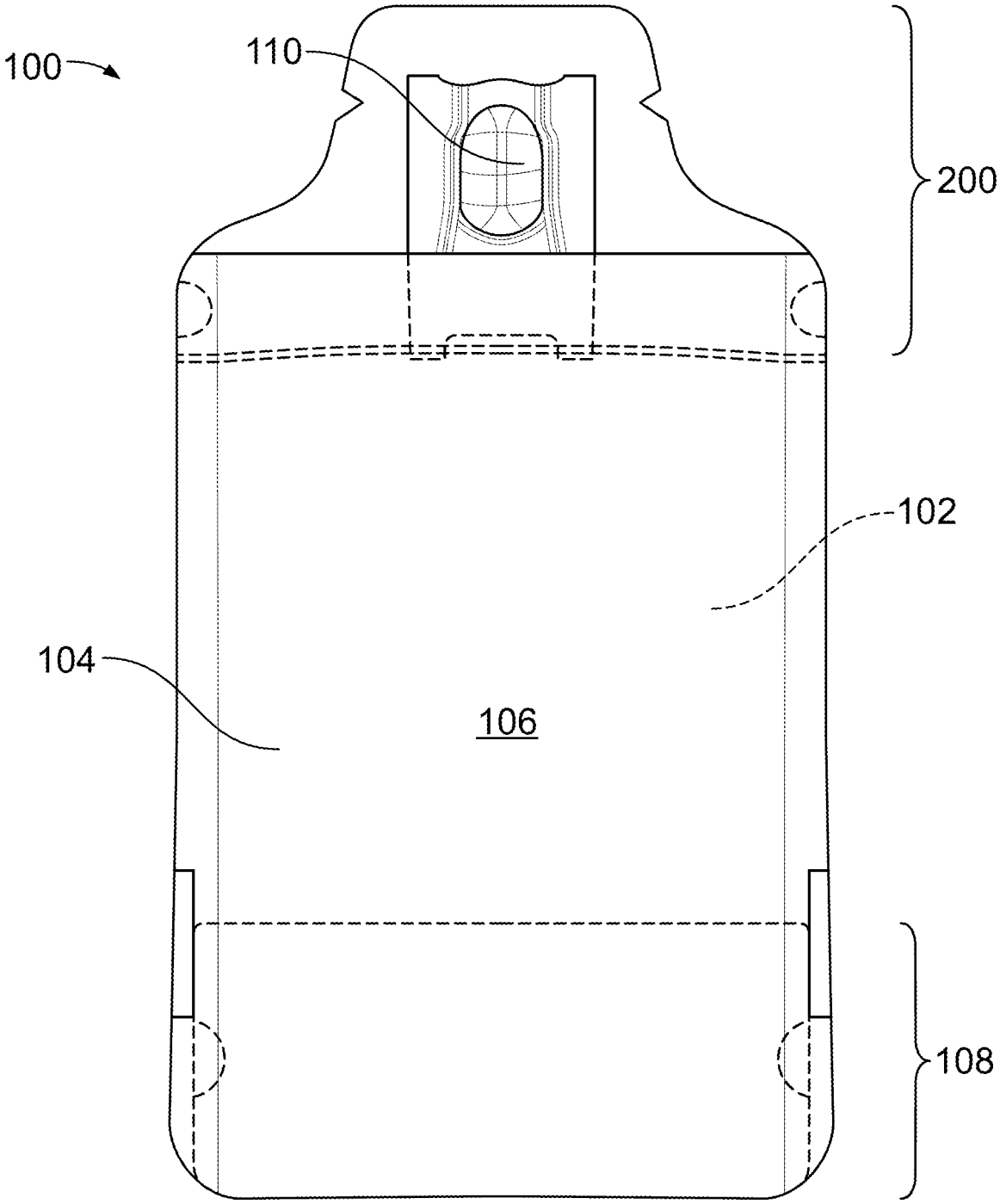
FIG. 1 illustrates a front plan elevational view of a pouch enclosure according to one example of the inventive subject matter described herein.
Figure 2:
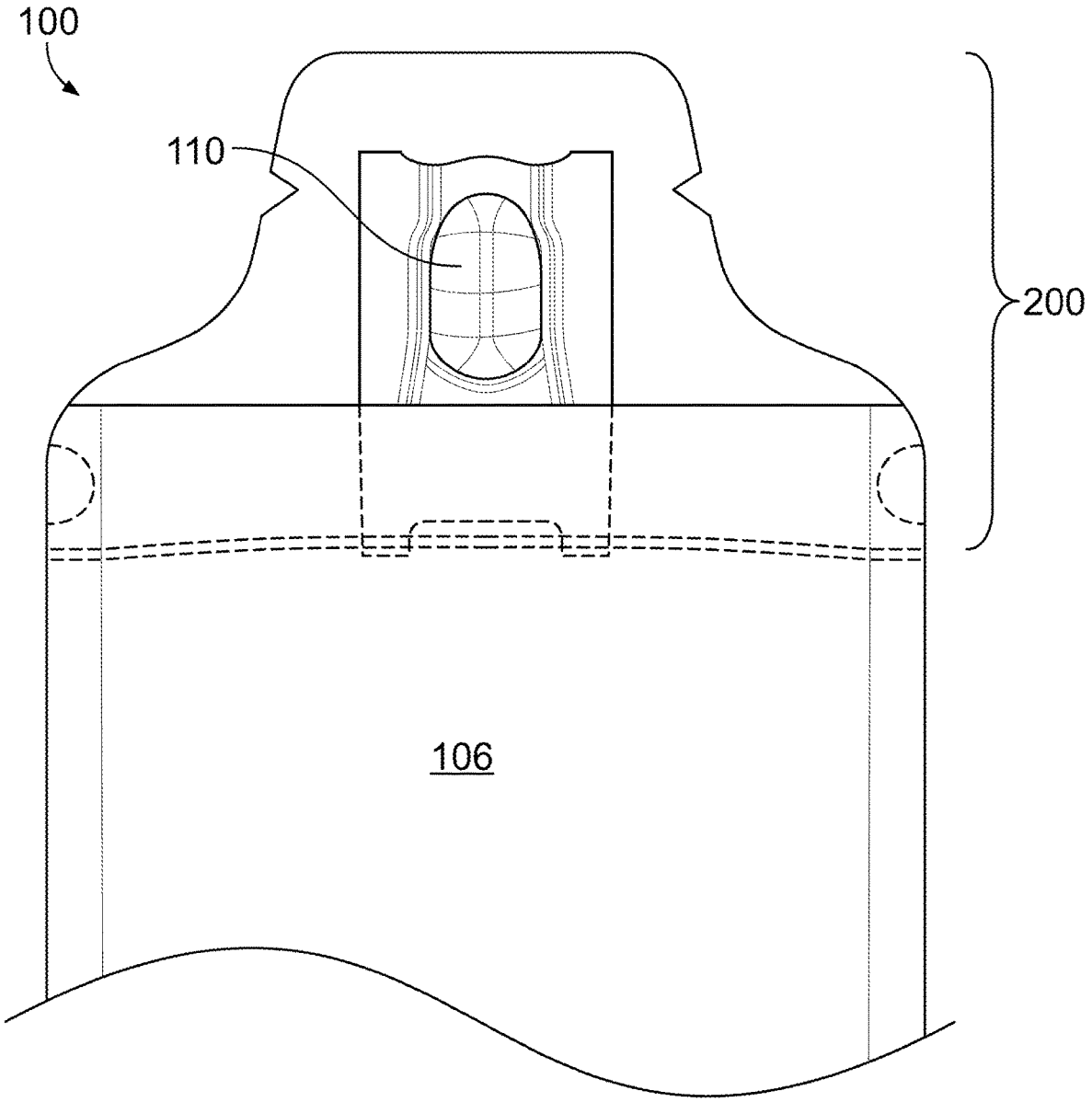
FIG. 2 illustrates a valve portion of the pouch enclosure shown in FIG. 1.

FIG. 1 illustrates a front plan elevational view of a pouch enclosure 100 according to one example of the inventive subject matter described herein. FIG. 2 illustrates a valve portion 200 of the pouch enclosure 100 shown in FIG. 1. The pouch enclosure 100 includes a front panel 102 formed from a flexible material and an opposite back panel 104 formed from the same or a different flexible material. Alternatively, one or both of the front panel 102 and/or the back panel 104 can be formed from a rigid or semi-rigid material. The front panel 102 and the back panel 104 can be coupled with each other along outer edges of the front panel 102 and the back panel 104 (e.g., heat sealed) to form an interior volume 106 in which product can be placed or loaded into the interior volume 106. The front panel 102 and the back panel 104 may be coupled with each other by a gusset bottom 108 that can expand to allow the pouch enclosure to vertically stand once product is loaded into the interior volume 106. Alternatively, the pouch enclosure 100 may not include a gusset at the bottom 108 of the pouch enclosure 100. The front panel 102 and the back panel 104 may be a single, continuous section or piece of material that is bent (e.g., to form a bottom of the enclosure 100) with the exposed side edges sealed to each other and the top side edges forming the opening into the interior volume 106 of the enclosure 100.

As shown in FIG. 2, a top or valve portion 200 of the pouch enclosure 100 may include a valve 110. This valve 110 may be a one-way valve or another type of valve. The valve portion 200 of the pouch enclosure 100 may be at an end of the pouch enclosure 100 that is opposite the end of the pouch enclosure 100 that includes the gusset bottom 108. The product in the interior volume 106 of the pouch enclosure 100 can be dispensed from the pouch enclosure 100 via or through the valve 110.

Figure 3:
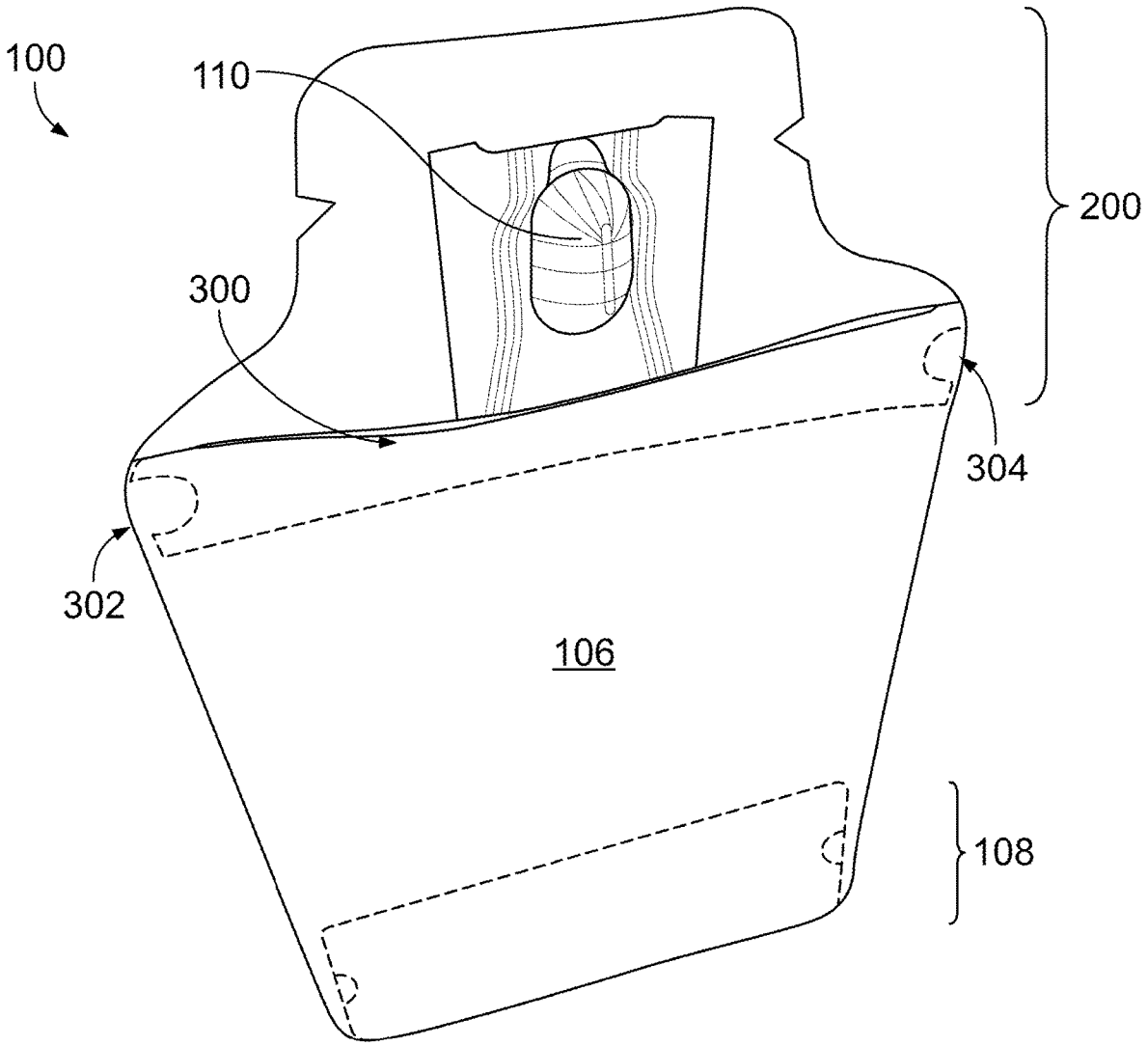
FIG. 3 illustrates a perspective view of an auxiliary port of the pouch enclosure shown in FIGS. 1 and 2.
Figure 4:
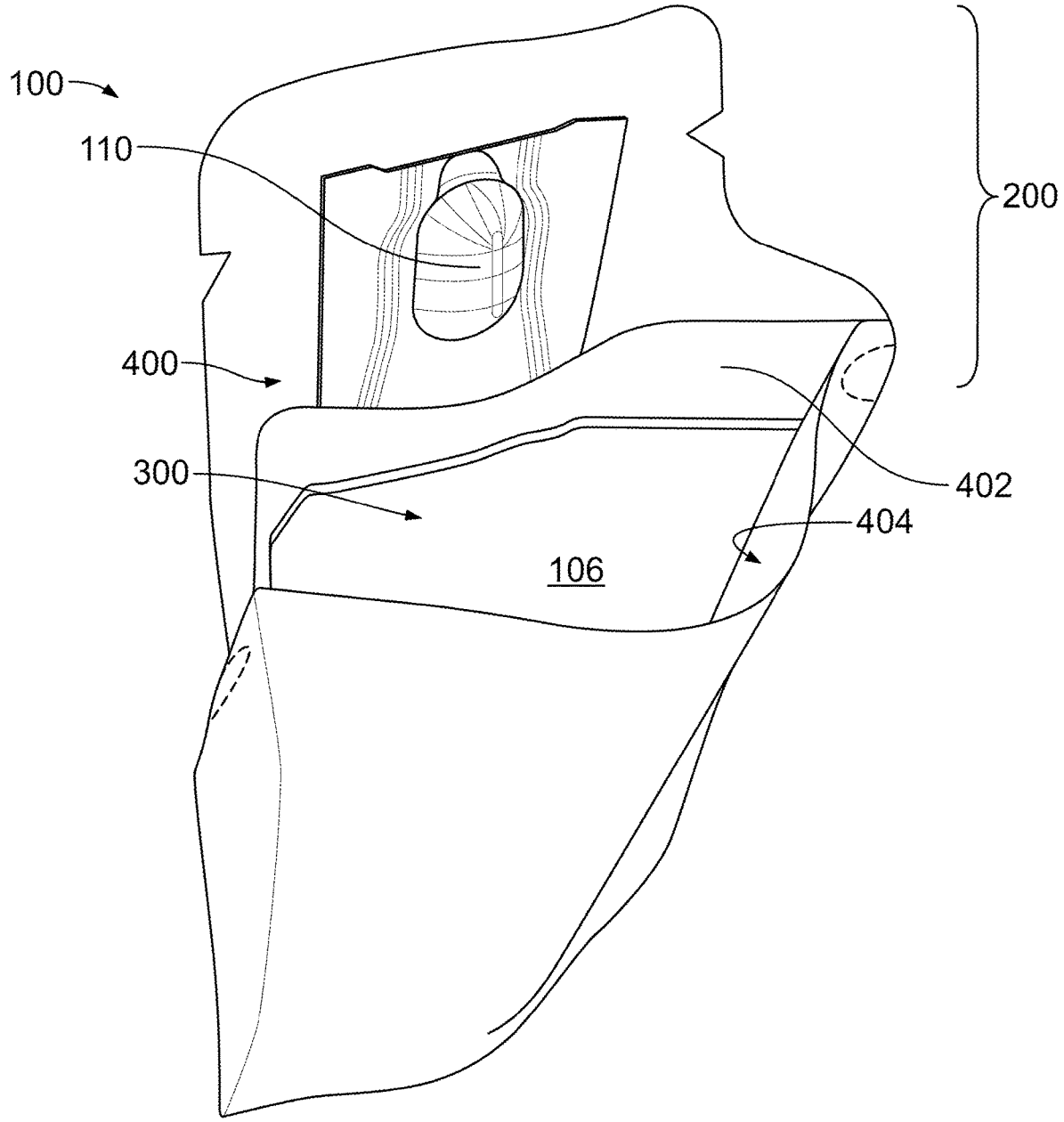
FIG. 4 illustrates another perspective view of the auxiliary port of the pouch enclosure shown in FIG. 3.

FIG. 3 illustrates a perspective view of an auxiliary port 300 of the pouch enclosure 100 shown in FIGS. 1 and 2. FIG. 4 illustrates another perspective view of the auxiliary port 300 of the pouch enclosure 100 shown in FIG. 3. The auxiliary port 300 can be an opening extending across the width of the back panel 104 from near one edge 302 of the pouch enclosure 100 (e.g., one intersection or seal between the front panel 102 and the back panel 104) to an opposite edge 304 of the pouch enclosure 100 (e.g., another, opposite intersection or seal between the front panel 102 and the back panel 104). The auxiliary port 300 can be opened by moving, pressing, forcing, etc. the edges 302, 304 of the pouch enclosure 100 toward each other, as shown in FIG. 4.

The product can be inserted or loaded into the interior volume 106 of the pouch enclosure 100 via the opened auxiliary port 300. The auxiliary port 300 can be sealed or closed shut by coupling a lower leg 402 of an upper gusset panel 400 (described below) with an interior surface 404 of the back panel 104. For example, the lower leg 402 of the upper gusset panel 400 can be heat sealed with the interior surface 404 of the back panel 104. Alternatively, the lower leg 402 of the upper gusset panel 400 can be coupled with the interior surface 404 of the back panel 104 using a press-to-close mechanism, a zipper, or the like. This can allow for the auxiliary port 300 to be later re-opened (e.g., for placing additional or a different material into the interior volume 106 of the pouch enclosure 100).

As shown, the auxiliary port 300 provides an opening into the interior volume 106 of the pouch enclosure 100 that is close to the valve 110. This opening can be closer to the valve 110 than other enclosures that form slits in the enclosures for filling the enclosures. This allows for the pouch enclosure 100 to be filled with more product and/or for more of the interior volume 106 of the pouch enclosure 100 to be filled with the product than the enclosures using slits for filling the enclosures (that are later sealed shut by an additional panel of material and/or by pulling a lower or upper side of the slit over the other side and sealing the slit shut) and/or enclosures that are filled from or through openings in the bottom of the enclosures.

Figure 5:
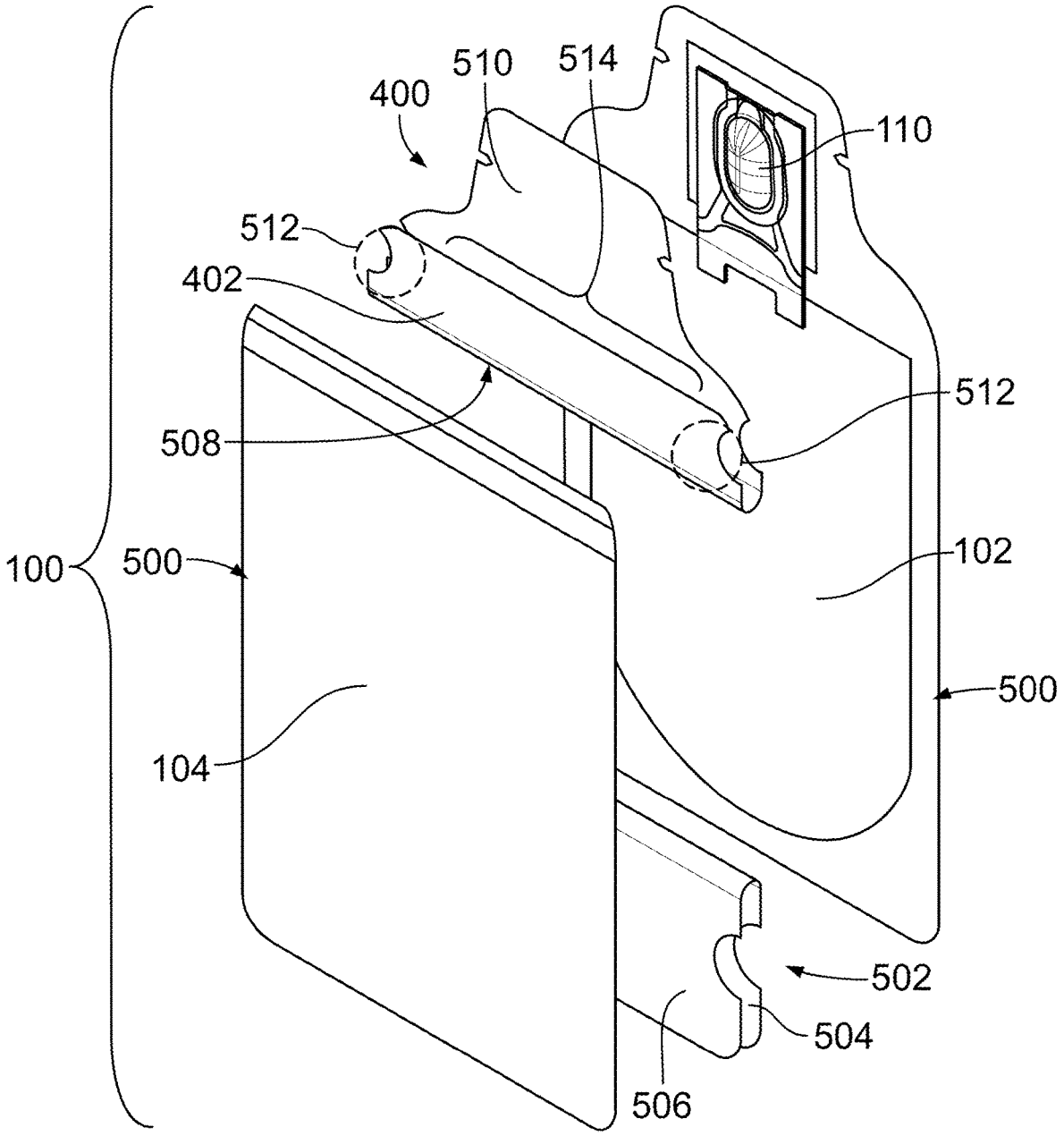
FIG. 5 illustrates an exploded view of the pouch enclosure shown in FIGS. 1 through 4.

FIG. 5 illustrates an exploded view of the pouch enclosure 100 shown in FIGS. 1 through 4. As described above, the pouch enclosure 100 includes the front panel 102 and the back panel 104. These panels 102, 104 may be coupled (e.g., heat sealed, adhered, etc.) to each other along outer edges 500 of the panels 102, 104 to form the interior volume 106 (shown in FIGS. 1 through 4).

The gusset bottom 108 (shown in FIGS. 1 through 3) of the enclosure 100 can be formed by a gusset panel 502 formed by a sheet or panel of flexible material that is bent to form two (or more) legs 504, 506. Alternatively, the gusset panel 502 can be formed by a single sheet that is not bent or multiple separate sheets of material that are coupled together. One leg 504 of the gusset panel 502 may be coupled with the front panel 102 while the other leg 506 of the gusset panel 502 may be coupled with the back panel 104. Alternatively, the front panel 102 may be coupled with the back panel 104 without the gusset panel 502 between the front panel 102 and the back panel 104.

The auxiliary port 300 shown in FIGS. 3 and 4 can be at least partially formed by the gusset panel 400. The gusset panel 400 can be formed by a single sheet or panel of material that is folded or bent to form a bend 508 between the lower leg 402 and an upper leg 510. Alternatively, the lower leg 402 may be referred to as a shorter leg 402 and the upper leg 510 may be referred to as a longer leg 510 as the shorter leg 402 extends a shorter distance from the bend 508 between the legs 402, 510 than the longer leg 510.

The valve 110 may be open along the back or rear side of the valve 110 shown in FIG. 5. The outer edges of the upper or longer leg 510 of the gusset panel 400 can be coupled with the outer edges of interior side of the front panel 102. The edge of the gusset panel 400 that extends along the bend 508 may not be coupled with the front panel 102 to allow the product in the interior volume 106 to move (e.g., flow) between the bend 508 and the gusset panel 400, and move out of the enclosure 100 via the valve 110.

The majority of the lower leg 402 of the gusset panel 400 may not be coupled with the interior surface of the back panel 104 prior to loading product in the interior volume 106 of the enclosure 100. For example, opposite lateral ends 512 of the lower or shorter leg 402 of the gusset panel 400 may be coupled with the back panel 104. These lateral ends 512 may be heat sealed or otherwise fixed to the back panel 104 while otherwise keeping a middle portion 514 of the lower or shorter leg 402 (that is between the lateral ends 512) separate from the back panel 104. As shown in FIG. 4, the middle portion 514 of the lower leg 402 of the gusset panel 400 may remain separate from the interior surface of the back panel 104 to allow the auxiliary port 300 to be opened. The product can be inserted into the interior volume 106 of the enclosure 100 via the auxiliary port 300. The middle portion 514 of the lower leg 402 of the gusset panel 400 may then be coupled with the interior surface of the back panel 104 of the enclosure 100 to close off the interior volume 106 of the enclosure 100 and to secure the product within the interior volume 106. The front and back panels 102, 104 may be pushed together (e.g., by squeezing the enclosure 100) to force the product out of the enclosure 100 via the valve 110.

As described above, placing the auxiliary port 300 closer to the top of the enclosure 100 and/or closer to the valve 110 can allow for more product to be inserted into the enclosure 100 and/or more of the interior volume 106 to be filled with product when compared with pouch enclosures that are filled through the gusset bottom (prior to sealing the gusset bottom due to the requirement to leave some volume to allow the gusset to be formed) and/or through a slit that is later sealed with another panel or by pulling the bottom or top of the panel below or above the slit over the slit.

Figure 6:
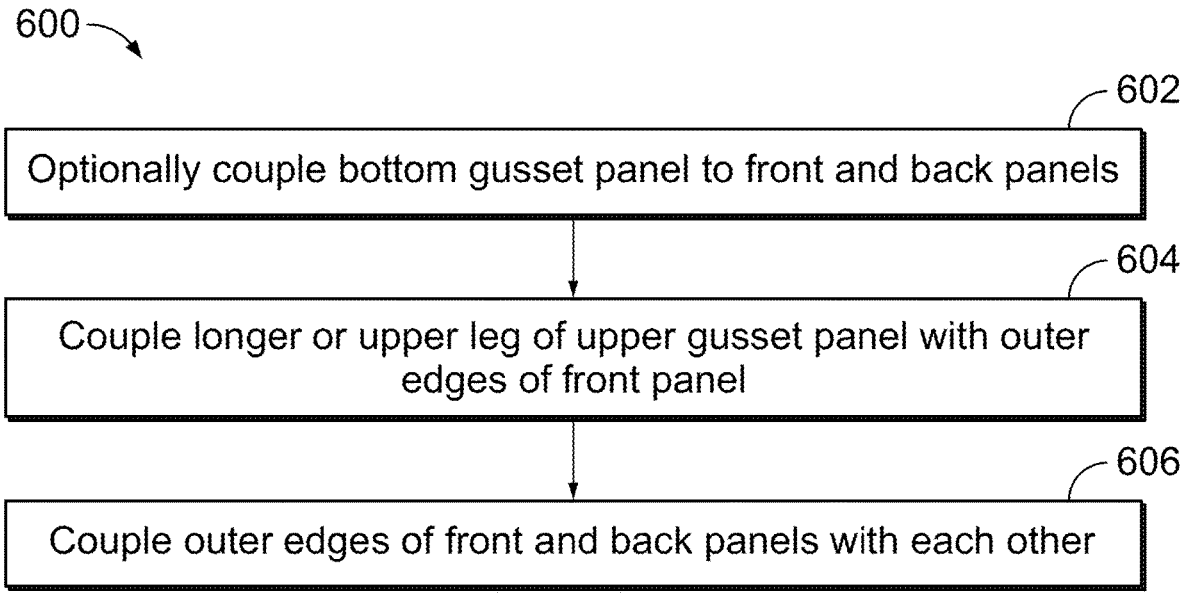
FIG. 6 illustrates a flowchart of one example of a method for forming a pouch enclosure.

FIG. 6 illustrates a flowchart of one example of a method 600 for forming a pouch enclosure. The method 600 may be used to form the pouch enclosure 100 shown in FIGS. 1 through 5. The order of operations in the method 600 may change or be different from the order shown in FIG. 6 and described herein. At 602, a bottom gusset panel optionally is coupled to front and back panels. For example, outer edges of the bottom gusset panel optionally can be heat sealed or otherwise affixed to outer edges of the front panel and the back panel. At 604, a longer or upper leg of an upper gusset panel is coupled with the front panel. For example, outer edges of the longer or upper leg of the upper gusset panel can be heat sealed or otherwise connected with outer edges of the front panel. The lower or shorter leg of the upper gusset panel may not be coupled with the front panel or back panel at this time. At 606, outer edges of the front and back panels are coupled with each other. Coupling the front and back panels with each other leaves a gap or opening between the back panel and the lower leg of the upper gusset panel. This gap or opening provides the auxiliary port through which product can be loaded into the interior volume of the enclosure formed by the gusset panels and the front and back panels, as described above.

In one example, an enclosure is provided that includes a first panel, a second panel coupled with the first panel along outer edges of the first panel and the second panel, and a gusset panel having first and second legs. The first leg may be coupled with the first panel. The second leg may have opposite ends and a middle portion with at least the middle portion separate from the first panel and the second panel. The second leg and the second panel may form an auxiliary port through which product can be loaded into an interior volume disposed between the first panel and the second panel. The middle portion of the second leg of the gusset panel may be coupled with the second panel after the product is loaded into the interior volume between the first panel and the second panel to enclose the product in the interior volume.

The first panel may include a valve through which the product is dispensed out of the interior volume. Outer edges of the first leg of the gusset panel may be coupled with outer edges of the first panel. The second leg of the gusset panel may be heat sealed or adhered to the second panel. The second leg of the gusset panel may be coupled with the second panel with a press-to-seal mechanism or zipper mechanism. The first leg of the gusset panel may be longer than the second leg of the gusset panel. The gusset panel may be an upper gusset panel and the enclosure may include a lower gusset panel having third and fourth legs. The third leg may be coupled with the first panel and the fourth leg may be coupled with the second panel to form a gusset bottom of the enclosure.

In another example, a method for forming an enclosure is provided. This method may include coupling a first panel with a second panel along outer edges of the first panel and the second panel, and coupling a first leg of a gusset panel with the first panel while keeping a middle portion of a second leg of the gusset panel separate from the first panel and the second panel. Separation of the middle portion of the second leg of the gusset panel from the second panel may form an auxiliary port through which product can be loaded into an interior volume disposed between the first panel and the second panel. The middle portion of the second leg of the gusset panel may be coupled with the second panel after the product is loaded into the interior volume between the first panel and the second panel to enclose the product in the interior volume.

The first panel may be coupled with the second panel by coupling the outer edges with each other outside of a valve in the first panel through which the product is dispensed out of the interior volume. Outer edges of the first leg of the gusset panel may be coupled with outer edges of the first panel. The method also may include coupling the second leg of the gusset panel to the second panel subsequent to enclosing the product in the interior volume. The second leg of the gusset panel may be coupled with the second panel by heat sealing the second leg to the second panel, using a press-to-seal mechanism, or using a zipper mechanism. The gusset panel may be an upper gusset panel and the method also may include coupling a lower gusset panel having third and fourth legs with the first panel and the second panel. The third leg of the lower gusset panel may be coupled with the first panel and the fourth leg of the lower gusset panel may be coupled with the second panel to form a gusset bottom of the enclosure.

In another example, a pouch enclosure is provided and may include a front panel having a valve through which a product is dispensed, a back panel coupled with the front panel along an outer edge of the front panel and the back panel, and a gusset panel having lower and upper legs separated from each other by a bend in the gusset panel. The upper leg may be coupled with the front panel. The lower leg may have at least a middle portion that is separate from the front panel and the back panel. The middle portion of the lower leg and the back panel may form an auxiliary port through which the product can be loaded into an interior volume disposed between the front panel and the back panel. The middle portion of the lower leg of the gusset panel may be coupled with the back panel after the product is loaded into the interior volume between the front panel and the back panel to enclose the product in the interior volume.

An outer edge of the lower leg of the gusset panel may be coupled with an outer edge of the front panel. The upper leg of the gusset panel may be heat sealed or adhered to the back panel after the product is loaded into the interior volume. The lower leg of the gusset panel may be coupled with the back panel with a press-to-seal mechanism or zipper mechanism. The upper leg of the gusset panel may be longer than the lower leg of the gusset panel. The gusset panel may be an upper gusset panel, and the enclosure may also include a lower gusset panel having first and second legs separated from each other by a bend. The first leg of the lower gusset panel may be coupled with the front panel and the second leg of the lower gusset panel may be coupled with the back panel to form a gusset bottom of the pouch enclosure.

The singular forms "a", "an", and "the" include plural references unless the context clearly dictates otherwise. "Optional" or "optionally" means that the subsequently described event or circumstance may or may not occur, and that the description may include instances where the event occurs and instances where it does not. Approximating language, as used herein throughout the specification and claims, may be applied to modify any quantitative representation that could permissibly vary without resulting in a change in the basic function to which it may be related. Accordingly, a value modified by a term or terms, such as "about," "substantially," and "approximately," may be not to be limited to the precise value specified. In at least some instances, the approximating language may correspond to the precision of an instrument for measuring the value. Here and throughout the specification and claims, range limitations may be combined and/or interchanged, such ranges may be identified and include all the sub-ranges contained therein unless context or language indicates otherwise.

This written description uses examples to disclose the embodiments, including the best mode, and to enable a person of ordinary skill in the art to practice the embodiments, including making and using any devices or systems and performing any incorporated methods. The claims define the patentable scope of the disclosure, and include other examples that occur to those of ordinary skill in the art. Such other examples are intended to be within the scope of the claims if they have structural elements that do not differ from the literal language of the claims, or if they include equivalent structural elements with insubstantial differences from the literal language of the claims.

What is claimed is:

1. An enclosure comprising:

a first panel;

a second panel sealed to the first panel along outer edges of the first panel and the second panel; and a gusset panel having first and second legs, the first leg coupled with the first panel, the second leg having opposite ends and a middle portion with at least the middle portion separate from the first panel and the second panel, the second leg and the second panel forming an auxiliary port through which product can be loaded into an interior volume disposed between the first panel and the second panel, the middle portion of the second leg of the gusset panel configured to be coupled with the second panel after the product is loaded into the interior volume between the first panel and the second panel to enclose the product in the interior volume.

2. The enclosure of claim 1, wherein the first panel includes a valve through which the product is dispensed out of the interior volume.

3. The enclosure of claim 1, wherein outer edges of the first leg of the gusset panel are coupled with outer edges of the first panel.

4. The enclosure of claim 1, wherein the second leg of the gusset panel is configured to be heat sealed or adhered to the second panel.

5. The enclosure of claim 1, wherein the second leg of the gusset panel is configured to be coupled with the second panel with a press-to-seal mechanism or zipper mechanism.

6. The enclosure of claim 1, wherein the first panel is a back panel and the second panel is a front panel that is opposite the back panel, the first leg of the gusset panel being longer than the second leg of the gusset panel.

7. The enclosure of claim 1, wherein the gusset panel is an upper gusset panel and further comprising a lower gusset panel having third and fourth legs, the third leg coupled with the first panel and the fourth leg coupled with the second panel to form a gusset bottom of the enclosure.

8. A method comprising:

sealing a first panel of an enclosure to a second panel along outer edges of the first panel and the second panel; and coupling a first leg of a gusset panel with the first panel while keeping a middle portion of a second leg of the gusset panel separate from the first panel and the second panel, wherein separation of the middle portion of the second leg of the gusset panel from the second panel forms an auxiliary port through which product can be loaded into an interior volume disposed between the first panel and the second panel, the middle portion of the second leg of the gusset panel configured to be coupled with the second panel after the product is loaded into the interior volume between the first panel and the second panel to enclose the product in the interior volume.

9. The method of claim 8, wherein the first panel is coupled with the second panel by coupling the outer edges with each other outside of a valve in the first panel through which the product is dispensed out of the interior volume.

10. The method of claim 8, wherein outer edges of the first leg of the gusset panel are coupled with outer edges of the first panel.

11. The method of claim 8, further comprising coupling the second leg of the gusset panel to the second panel subsequent to enclosing the product in the interior volume.

12. The method of claim 11, wherein the second leg of the gusset panel is coupled with the second panel using a press-to-seal mechanism or using a zipper mechanism.

13. The method of claim 8, wherein the gusset panel is an upper gusset panel and further comprising coupling a lower gusset panel having third and fourth legs with the first panel and the second panel, the third leg of the lower gusset panel coupled with the first panel and the fourth leg of the lower gusset panel coupled with the second panel to form a gusset bottom of the enclosure.

* * * * *